US005544580A

United States Patent [19]

Takahashi

[11] Patent Number: 5,544,580

[45] Date of Patent: Aug. 13, 1996

[54] MIMEOGRAPHIC PRINTING MACHINE HAVING SHEET JAMMING DETECTOR

[75] Inventor: Yasuhiro Takahashi, Tokyo, Japan

[73] Assignee: Riso Kagaku Corporation, Tokyo, Japan

[21] Appl. No.: 396,526

[22] Filed: Mar. 1, 1995

[30] Foreign Application Priority Data

Mar. 1, 1994 [JP] Japan ..... 6-031381

[51] Int. Cl.[6] ..... B41L 13/04; B41F 33/06

[52] U.S. Cl. ..... 101/118; 101/484; 271/258.01; 271/258.02

[58] Field of Search ..... 101/116, 117, 101/118, 232, 233, 242, 484; 271/256, 258.01, 258.02, 258.05, 259, 273, 274; 400/708

[56] References Cited

U.S. PATENT DOCUMENTS

| | | | |
|---|---|---|---|
| 4,237,466 | 12/1980 | Scranton | 347/104 |
| 4,628,813 | 12/1986 | Hasegawa et al. | 101/116 |
| 4,630,815 | 12/1986 | Petersen et al. | 271/273 |
| 5,081,924 | 1/1992 | Ohinata | 101/116 |
| 5,280,322 | 1/1994 | Kono | 271/259 |

FOREIGN PATENT DOCUMENTS

| | | | |
|---|---|---|---|
| 1346173 | 11/1963 | France . | |
| 138048 | 5/1980 | Japan | 271/258.01 |
| 203027 | 11/1984 | Japan | 271/256 |
| 3-24989 | 2/1991 | Japan . | |
| 3-254984 | 11/1991 | Japan . | |

OTHER PUBLICATIONS

IBM Technical Disclosure Bulletin vol. 18, No. 10 "Articulated Roll and Document Gate Mechanism" Baumberger et al. p. 3199 Mar. 1976.

*Primary Examiner*—Stephen Funk
*Attorney, Agent, or Firm*—Sughrue, Mion, Zinn, Macpeak & Seas

[57] ABSTRACT

A mimeographic printing machine including: a pair of first and second sheet supplying rollers, the first sheet supplying roller being movable into and out of contact with the second sheet supplying roller, the first and second sheet supplying rollers clamping a printing sheet when the first sheet supplying roller touches to the second sheet supplying roller, and the first and second sheet supplying rollers being rotatable to convey the printing sheet; a rotary cylindrical drum having a tubular wall on which a stencil paper is wound; a pushing device for pushing the printing sheet conveyed by rotating the first and second sheet supplying rollers against the stencil paper wound on the rotary cylindrical drum in order to perform a mimeographic printing operation; a jamming detector for detecting abnormal conveyance of printing sheets in a printing-sheet conveying path; a preventing device for preventing the first sheet supplying roller from approaching the second sheet supplying roller; and a controller for activating the preventing device when the jamming detector detects the abnormal conveyance of the printing sheet in the printing-sheet conveying path.

4 Claims, 8 Drawing Sheets

MIMEOGRAPHIC PRINTING MACHINE HAVING SHEET JAMMING DETECTOR

BACKGROUND OF INVENTION

1. Field of Invention

This invention relates to a rotary mimeographic printing machine.

2. Description of Prior Art

Two kinds of rotary mimeographic printing machines are known in the art: In one of the rotary mimeographic printing machines, as disclosed for instance by Unexamined Japanese Patent Publication No. Hei. 3-24989, ink is supplied into the rotary cylindrical drum, and the press roller is operated to push a printing sheet against a stencil paper wound on the rotary cylindrical drum.

In the other rotary mimeographic printing machine, as disclosed by Unexamined Japanese Patent Publication No. Hei. 3-254984, the rotary cylindrical drum is made of flexible material, and an inside pusher roller is set inside the rotary cylindrical drum to elastically deform the tubular wall of the rotary cylindrical drum outwardly, and a lower pusher roller is provided outside the rotary cylindrical drum in such a manner that its rotary axis is in parallel with the axis of the drum. A printing sheet is set between the rotary cylindrical drum and the lower pusher roller, and then printed while being held between the lower pusher roller and the outer cylindrical wall of the cylindrical drum which is deformed by the inside pusher roller.

In order to adjust the top and bottom printing positions of the printing sheet, the above-described mimeographic printing machine has a sheet supplying mechanism for taking out printing sheets one at a time, and a pair of upper and lower sheet supplying rollers adapted to clamp and convey a printing sheet. Those upper and lower sheet supplying rollers are operated in synchronization with the rotation of the rotary cylindrical drum; that is, they are moved towards each other to clamp the printing sheet and convey it towards the rotary cylindrical drum (the printing station), and they are moved away from each other after the rotary cylindrical drum turns through a predetermined angle (or after it turns for a predetermined period of time).

When, in the above-described mimeographic printing machine, a printing sheet is not correctly conveyed along the sheet conveying path; that is, it is caught in the sheet conveying path, the machine is stopped to check abnormal points and to remove the sheet. In this case, sometimes the pair of sheet supplying rollers holding the printing sheet are stopped while being kept in contact with each other, and it is considerably difficult to remove the sheet from the sheet supplying rollers thus stopped. Furthermore, after being caught, the printing sheet may be pushed deep into the machine by the sheet supplying rollers. As is apparent from the above description, the conventional mimeographic printing machine suffers from the problem that, when a printing sheet is caught in the machine, it is considerably difficult to remove the printing sheet from the machine.

SUMMARY OF INVENTION

Accordingly, an object of the invention is to solve the above-described problem accompanying a conventional mimeographic printing machine.

To achieve the object, a first aspect of the invention is to provide a mimeographic printing machine which comprises: a pair of first and second sheet supplying rollers, the first sheet supplying roller touchable to and departable from the second sheet supplying roller, the first and second sheet supplying rollers clamping a printing sheet when the first sheet supplying roller touches to the second sheet supplying roller, and the first and second sheet supplying rollers rotatable to convey the printing sheet; a rotary cylindrical drum having a tubular wall on which a mimeographich stencil paper is wound; pushing means for pushing the printing sheet conveyed by rotating the first and second sheet supplying rollers against the stencil paper wound on the rotary cylindrical drum in order to perform a mimeographic printing operation; jamming detecting means for detecting abnormal conveyance of printing sheets in a printing-sheet conveying path; preventing means for preventing the first sheet supplying roller from approaching the second sheet supplying roller; and control means for activating the preventing means when the jamming detecting means detects the abnormal conveyance of the printing sheet in the printing-sheet conveying path.

A second aspect of the invention is to provide the mimeographic printing machine described above further comprising: a shaft provided in parallel with the axis of the first sheet supplying roller; and an arm member swingable about the shaft, the arm member mounting the first sheet supplying roller thereon. The preventing means of the mimeographic printing machine includes: a stopper protruded on the locus of swing of the arm member, for preventing the arm member from moving; and drive means for moving the stopper.

According to the mimeographic machine of the invention, when the jamming detecting means detects the abnormal conveyance of printing sheets in the printing-sheet conveying path, the control means activates the preventing means. The preventing means prevents the one sheet supplying roller from approaching the other sheet supplying roller. Hence, when the jamming of printing sheets occurs in the machine, the printing sheets will never be pushed deep into the machine by the sheet supplying rollers.

DETAILED DESCRIPTION OF THE PREFERRED EMBODIMENTS

Figure 1:
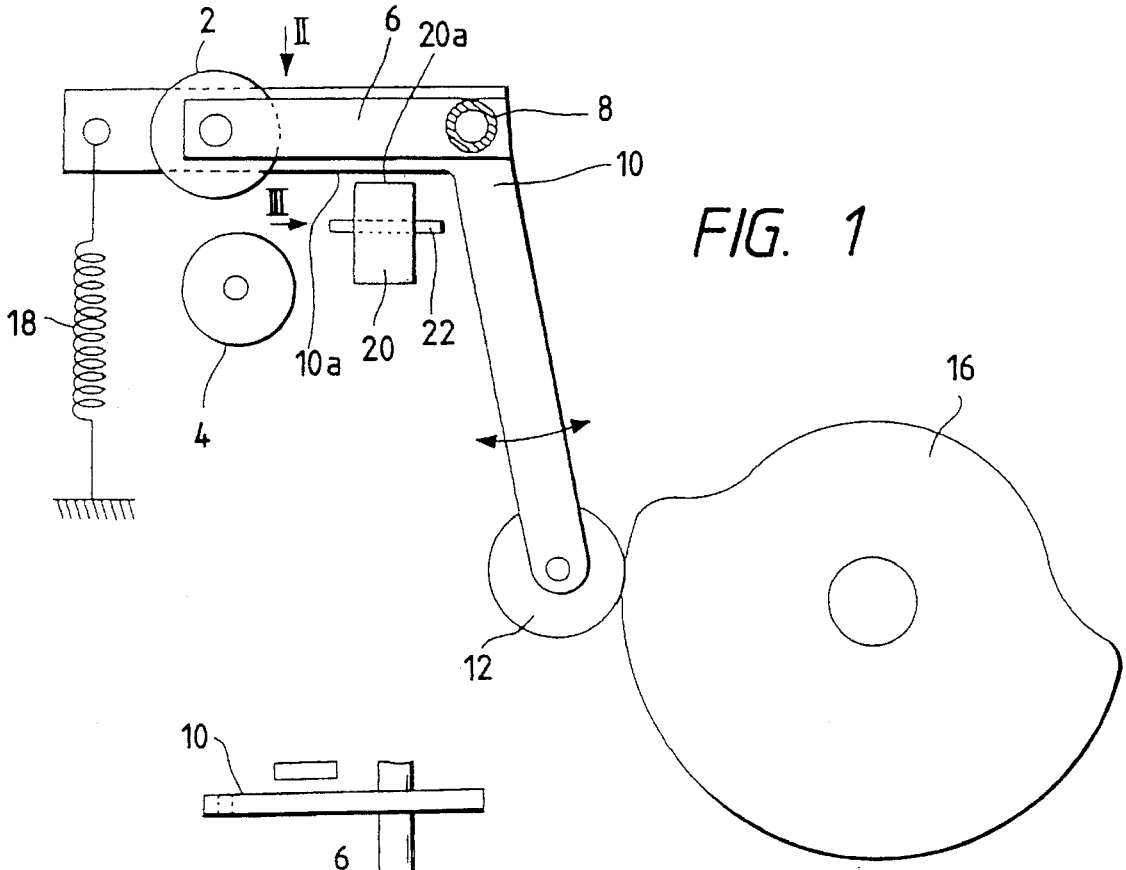
FIG. 1 is a partly enlarged diagram of a mimeographic printing machine according to the present invention.

A mimeographic printing machine of the invention, will be described with reference to FIGS. 1 through 10.

First, the arrangement of a flexible rotary cylindrical drum for mimeographic printing will be described. In FIGS. 5 through 8 showing the mimeographic printing machine of the invention, reference numeral 1 designates the aforementioned flexible rotary cylindrical drum. The flexible rotary cylindrical drum 1 comprises: two disk-shaped solid side boards 103 at both ends; a solid member, namely, a clamp base plate 105 through which the two side boards 103 are coupled to each other; and a cylindrical screen member 109 both ends of which are supported by the side boards 103.

The screen member 109 is a flexible net made of flexible wires such as stainless steel wires, forming a flexible tubular wall 107 having meshes through which printing ink is passed. The flexible tubular wall 107 is radially deformable.

A clamp plate 111 is mounted on the clamp base plate 105, to detachably hold one end (the front end) of a stencil paper. The stencil paper is locked to the clamp base plate 105 by the clamp plate 111, and wound on the flexible cylindrical wall 107 as the cylindrical drum 1 turns.

The flexible rotary cylindrical drum 1 is rotatably supported on a central cylindrical shaft 113 which is extended along the axis of the drum 1. Drum driving gears 115 are formed in the outer peripheries of the two side boards 113. The drum driving gears 115 thus formed are engaged with the drive gear of a drum driving motor (not shown). As the motor rotates, the flexible rotary cylindrical drum 1 is turned counterclockwise in the figure.

Inside the flexible rotary cylindrical drum 1, an inside frame 117 is supported at a fixed position by the central cylindrical shaft 113. The inside frame 117 supports one end of an inside pusher arm 121 so that the other end of the latter 121 is vertically swingable. An inside pusher roller 123 is rotatably supported by the middle portion of the inside pusher arm 121. The axis of the inside pusher roller 123 is in parallel with the axis of the flexible rotary cylindrical drum 1. As the inside pusher arm 121 swings, the inside pusher roller 123 is brought into sliding contact with the inner surface of the flexible rotary cylindrical drum 1.

The inside pusher roller 123 serves also as an ink supplying squeeze roller. A doctor rod 125 is fixedly secured to the inside pusher arm 121 in such a manner that it is slightly spaced from the inside pusher roller 123 and is in parallel with the latter 123. Printing ink is regularly supplied from an ink supplying pipe 129 into the space between the inside pusher roller 123 and the doctor rod 125, thus forming an ink pool 127 wedge-shaped in section. The ink supplying pipe 129 is connected to an ink supplying hose 131 which is extended through the central cylindrical shaft 113 and laid outside the rotary cylindrical drum 1, and finally connected to an ink supply source (not shown) provided outside the rotary cylindrical drum 1.

When the inside pusher roller 123 is turned counterclockwise in the figure, the printing ink in the ink pool 127 is measured while passing through the small gap between the doctor rod 125 and the inside pusher rod 125, thus being supplied to the inner surface of the screen member 109.

The inside frame 117 rotatably supports a cam shaft 133 on which a cam 135 is fixedly mounted. The cam 135 is a double-heart-shaped plate cam. The cam 135 is turned through 90° each time, thus taking a printing position as shown in FIGS. 5 and 7 or a non-printing position as shown in FIGS. 6 and 8.

A linkage yoke member 137 is coupled through a shaft 141 to the other end of the inside pusher arm 121. A cam follower 139 is mounted on the linkage yoke member 137, and engaged with the aforementioned cam 135.

Figure 5:
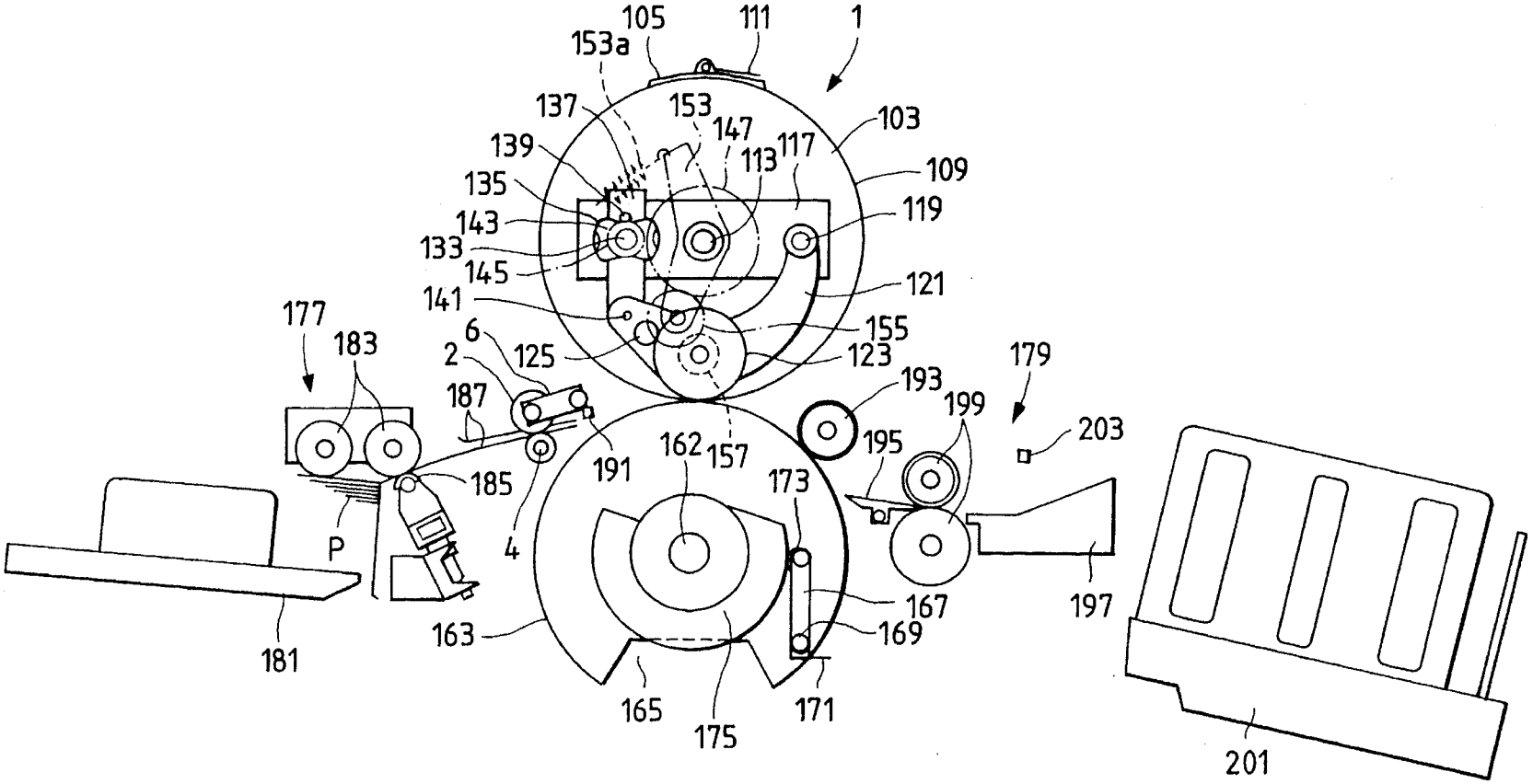
FIG. 5 is an explanatory diagram showing the arrangement of the mimeographic printing machine of the invention which is in operation.
Figure 6:
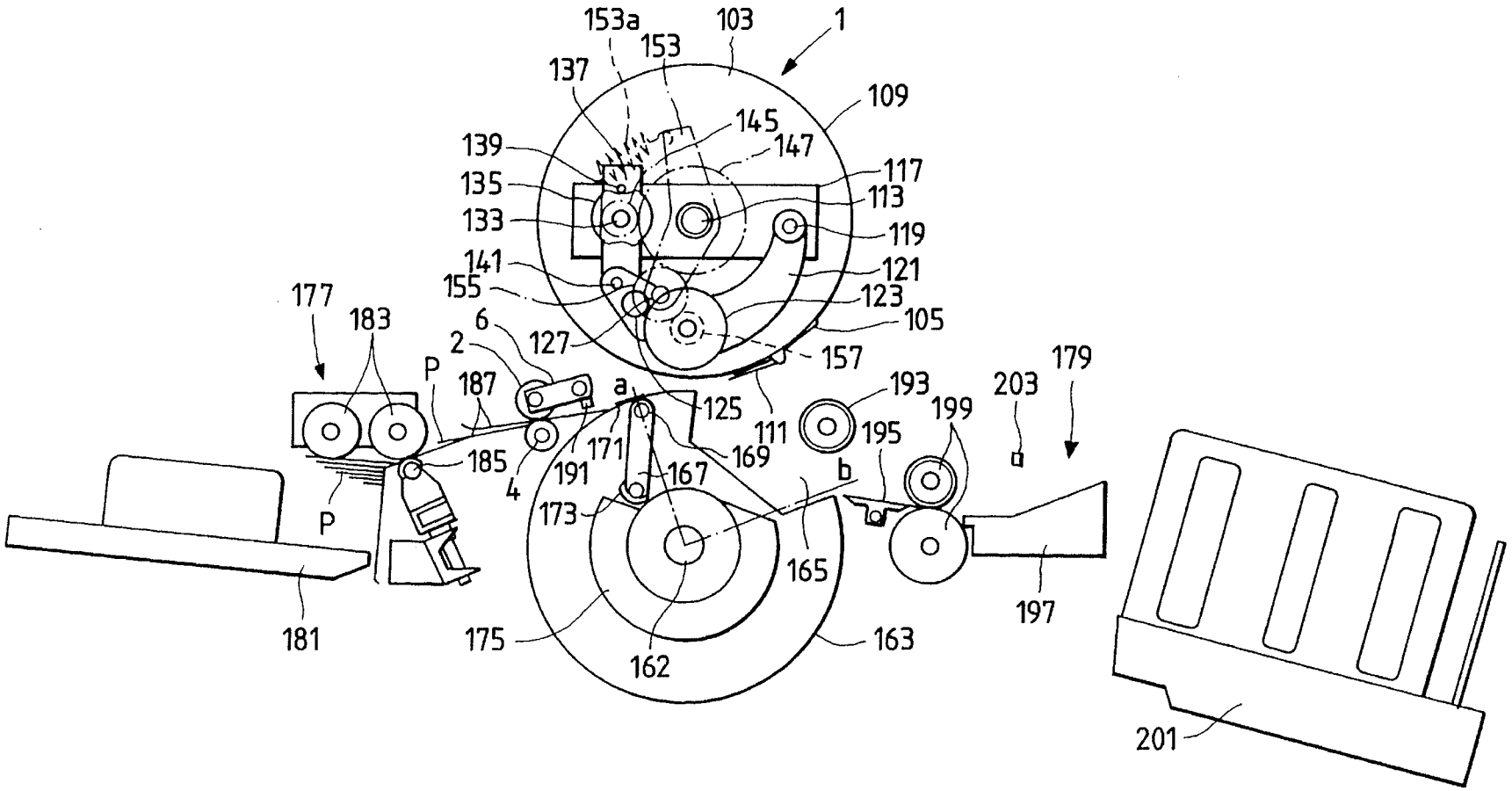
FIG. 6 is an explanatory diagram showing the arrangement of the mimeographic printing machine of the invention which is not in operation.

When the cam 135 is at the printing position as shown in FIG. 5, the inside pusher roller 123 is located at a lower position where it is in sliding contact with the inner surface of the screen member 109 of the flexible rotary cylindrical drum 1. When, on the other hand, the cam 135 is at the non-printing position as shown in FIG. 6, the inside pusher roller 123 together with the inside pusher arm 121 is raised, thus moving away from the inner surface of the screen member 109.

Figure 7:
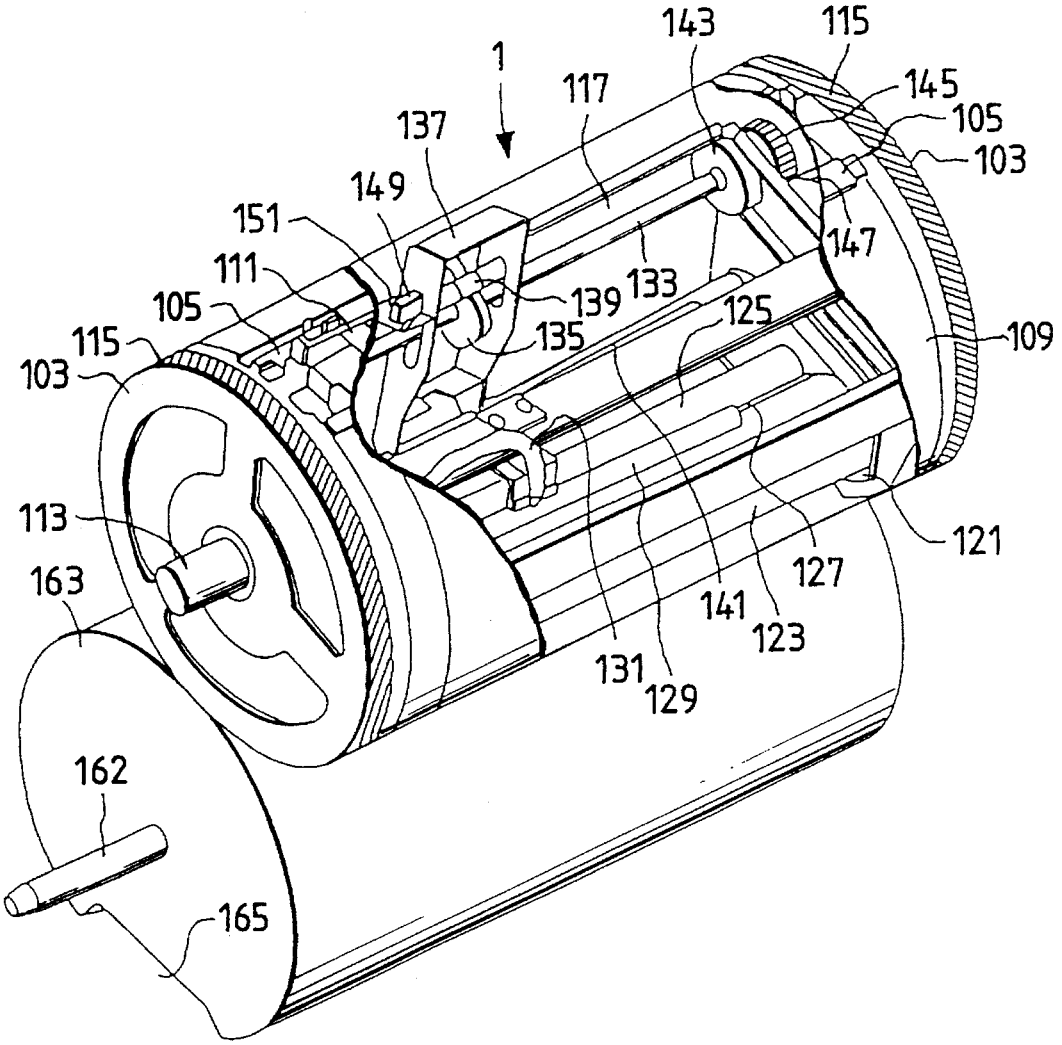
FIG. 7 is a perspective view, with parts cut away, partly showing of the mimeographic printing machine which is in operation.
Figure 8:
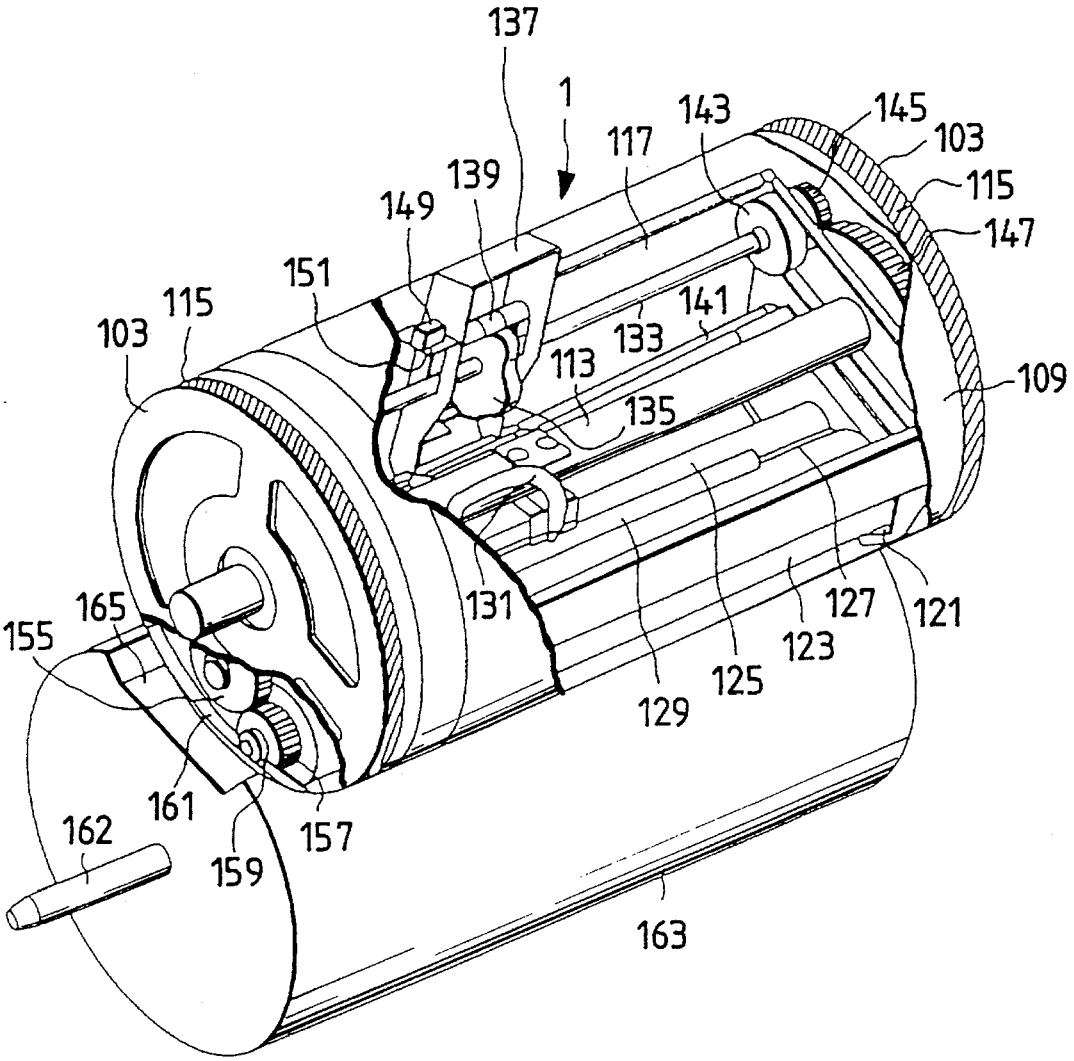
FIG. 8 is also a perspective view, with parts cut away, partly showing of the mimeographic printing machine which is not in operation.

As shown in FIGS. 7 and 8, the cam shaft 133 is connected to the driven side of an electromagnetic clutch 143, the driving side of which is connected to a cam shaft drive gear 145. Thus, the cam shaft drive gear 145 and the cam shaft 133 are selectively coupled to each other. The cam shaft drive gear 145 is engaged with an inside main gear 147 secured to the side board 103 of the flexible rotary cylindrical drum 1, so that it is turned as the rotary cylindrical drum 1 turns.

A cam switch 149 made up of a limit switch is mounted on the inside frame 117. The cam switch 149 is engaged with a switch actuating piece 151 coupled to the linkage yoke member 137, to detect whether the cam 135 is at the printing position or whether it is at the non-printing position.

As shown in FIGS. 5 and 6, inside the flexible rotary cylindrical drum 1, the central cylindrical shaft 113 swingably supports a roller drive arm 153 at the middle. An intermediate gear 155 is rotatably mounted on one end of the roller drive arm, the other end of which is connected through a tension spring 153*a*. The elastic force of the tension spring 153 urges the roller drive arm 153 to turn counter-clockwise about the central cylindrical shaft 113.

With the roller drive arm 153 being urged in this way, the intermediate gear 155 is engaged with the inside main gear 147 and with a gear 157 mounted on the end of the inside pusher roller 123. Hence, as the flexible rotary cylindrical drum 1 turns, the intermediate gear 155 is turned to rotate the inside pusher roller 123 counter-clockwise through the gear 157.

When, under the condition that the cam 135 is at the printing position and the inside pusher roller 123 is at the lower position where it is in sliding contact with the inner surface of the screen member 109 of the flexible rotary cylindrical drum 1, the inside pusher roller 123 is turned counterclockwise in the above-described manner, the latter 123 pushes the screen member 109 radially outwardly of the flexible rotary cylindrical drum 1; that is, the inside pusher roller 123 inflates the screen member 109 towards a lower pusher roller 163 (described later) so that the screen member 109 is set at an inflation position (as shown in FIG. 5).

On the other hand, when, under the condition that the cam 135 is at the non-printing position and the inside pusher roller 123 is spaced away from the inner cylindrical surface of the screen member 109 of the flexible rotary cylindrical drum 1, the inside pusher roller 123 is turned counterclockwise in the above-described manner, the inside pusher roller 123 will not inflate the screen member 109. This position (as shown in FIG. 6) of the inside pusher roller 123 will be referred to as "a steady position", when applicable.

As shown in FIG. 8, a cam follower 159 is mounted on the end of the rotary shaft of the inside pusher roller 123 in such a manner that it is engaged with a cam 161 formed in the inner cylindrical surface of the flexible rotary cylindrical drum 1. As the flexible rotary cylindrical drum 1 turns, the cam 161 raises the inside pusher roller 123 when the phase of rotation of the drum 1 corresponds to a stencil paper clamping region of the flexible rotary cylindrical drum 1, so that the screen member 109 is released from the inside pusher roller 123.

The aforementioned lower pusher roller 163 is provided below the flexible rotary cylindrical drum 1. The lower pusher roller 163 is equal in diameter to the flexible rotary cylindrical drum 1. The lower pusher roller 163 has a central shaft 162, and it is a predetermined distance away from the screen member 109 and is in parallel with the flexible rotary cylindrical drum 1. A synchronous rotating device (not shown) is provided to turn the lower pusher roller 163. The latter 163 is turned clockwise (in FIG. 5 or 6) around the central shaft 162 in synchronization with the flexible rotary cylindrical drum 1 at the same speed as the latter 1. The lower pusher roller 163 has a recess 165 in the part of its outer periphery which corresponds to the stencil paper clamping region of the flexible rotary cylindrical drum 1, to prevent the interference with the stencil paper clamping region.

When the screen member 109 is inflated as shown in FIG. 5, because of the relative position of the flexible rotary cylindrical drum 1 and the lower pusher roller 163 the stencil paper wound on the rotary cylindrical drum 1 and the printing sheet P are pushed against each other by the inflated portion of the flexible rotary cylindrical drum 1 and the lower pusher roller 163. When the inflation of the screen member 109 is eliminated as shown in FIG. 6, a gap is formed between the flexible rotary cylindrical drum 1 and the lower pusher roller 163 through which the printing sheet P passes freely.

The lower pusher roller 163 has a sheet clamping member 167. One end portion of the latter 167 is coupled through a shaft 169 to the lower pusher roller 163 in such a manner that the sheet clamping member 167 is swingable about the shaft 169. The one end portion of the sheet clamping member 167 is provided with a clamping piece 171 which is adapted to detachably hold the front edge of the printing sheet P in cooperation with the outer cylindrical surface of the lower pusher roller 163. A cam follower 173 is provided on the other end portion of the sheet clamping member 167. A cam 175 is fixedly mounted on the central shaft 162 of the lower pusher roller 163 at a predetermined position. The cam 175 is engaged with the aforementioned cam follower 173.

Hence, as the lower pusher roller 163 turns, the clamping piece 171 is operated together with the sheet clamping member 167 which is turned in synchronization with the lower pusher roller 163. That is, the clamping piece 171 holds the front edge of the printing sheet P at a predetermined angular position a (a sheet clamping position a) shown in FIG. 6 which is supplied from a sheet supplying section 177 (shown in the left part of FIG. 6). The clamping piece 171 releases it at a predetermined angular position b (a sheet releasing position a) on the side of a sheet discharging section 179 shown in the right part of FIG. 6.

As is apparent from the above description, the lower pusher roller 163 acts as a roller having a printing sheet conveying function which, between the sheet clamping position a and the sheet releasing position b, winds a printing sheet P on it and forcibly conveys the printing sheet P.

The sheet supplying section 177, as shown in FIG. 5, comprises: a sheet supplying stand 181 on which a plurality of printing sheets P are stacked; sheet supplying rollers 183 and a sheet separating roller 185 which are adapted to take the printing sheets P out of the sheet supplying stand 181 one at a time; a pair of sheet supplying rollers 2 and 4 for sending a printing sheet P to the aforementioned sheet clamping position a with predetermined timing; and a sheet supplying optical sensor 191 for detecting the arrival of a printing sheet P at the sheet clamping position a.

Figure 2:
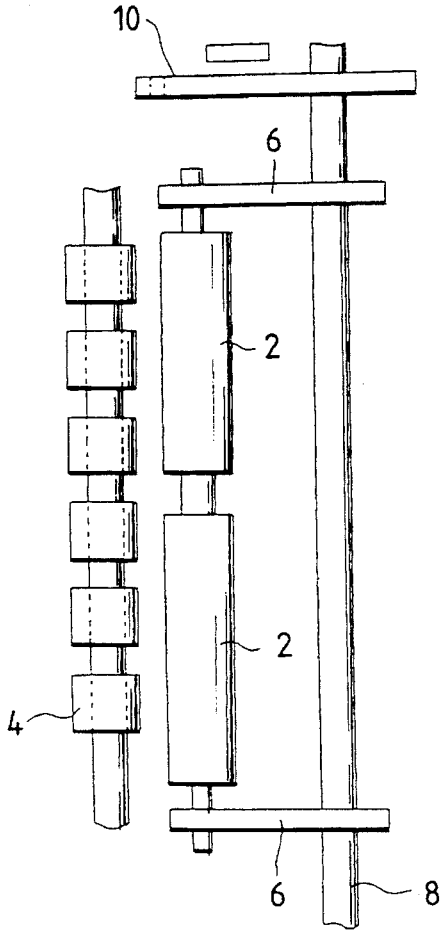
FIG. 2 is a view taken in the direction of the arrow II in FIG. 1.
Figure 3:
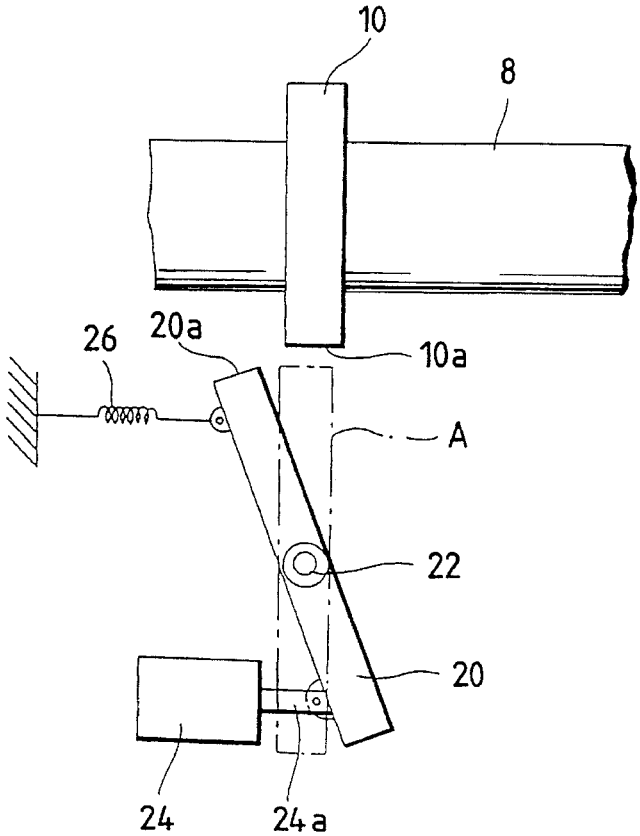
FIG. 3 is a view taken in the direction of the arrow III in FIG. 1.
Figure 4:
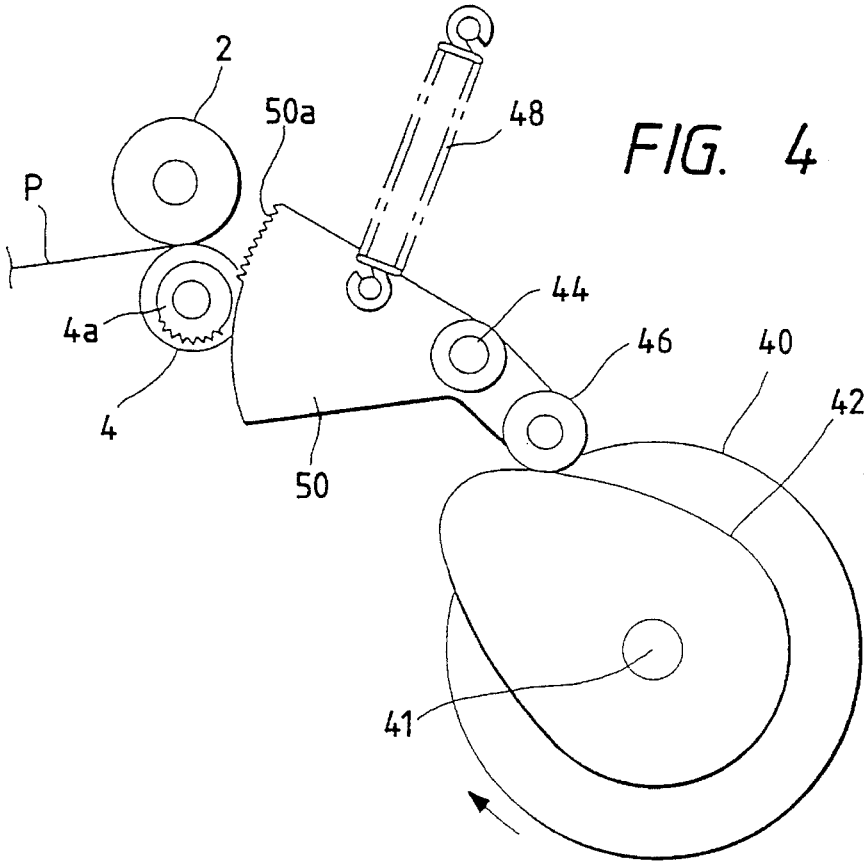
FIG. 4 is a diagram showing a mechanism for driving a pair of sheet supplying rollers in the mimeographic printing machine according to the invention.

The arrangement of the aforementioned pair of sheet supplying rollers 2 and 4 will be described with reference to FIGS. 1 through 4 in more detail. The sheet supplying roller 2 is located above the sheet supplying roller 4. For clarification in illustration, in FIG. 2 the lower sheet supplying roller 4 is shown shifted to the left of the upper sheet supplying roller 2. As shown in FIGS. 1 through 3, the lower sheet supplying roller 4 is freely rotatable, and the upper sheet supplying roller 2 is rotatably mounted on first end portions of arm members 6, the remaining second end portions of which are secured to a shaft 8, which is rotatably mounted through its both ends on a machine frame (not shown).

As shown in FIG. 1, the middle of a lever 10 is fixedly secured to one end portion of the shaft 8 which is located outside one of the arm members 6. The lever 10 is substantially L-shaped being bent a predetermined angle substantially at the middle. A cam follower 12 is rotatably mounted on one end of the lever 10. The cam follower 12 is abutted against a timing cam 16 which is coaxial with the above-described lower pusher roller 163. A spring 18 is connected to the other end of the lever 10, urging the latter 10 counterclockwise about the shaft 8. Hence, the cam follower 12 at the one end of the lever 10 is abutted against the timing cam 16 by the elastic force of the spring 18.

Preventing means for preventing the upper sheet supplying roller 2 from approaching the lower sheet supplying roller 4 is provided below the lever 10. The preventing means comprises a stopper 20; and means for driving the stopper 20, namely, a solenoid 24 secured to the machine body. The stopper 20 is in the form of a rectangular plate which is swingable about a shaft 22. More specifically, the shaft 22 is passed through the middle of the plate-shaped stopper 20 in such a manner that it is extended along the short side of the latter 20, and both ends of the shaft 22 are secured to the machine body. The lower end portion of the stopper 20 is coupled to a movable part **24*a* of the solenoid 24, while the upper end portion of the stopper 20 is coupled through a spring 26 to a stationary part of the machine body, so that the stopper 22 is urged counterclockwise about the shaft 22 as viewed in FIG. 3. The stopper 20 is provided at the position where, with the upper sheet supplying roller 2 being farthest from the lower sheet supplying roller 4, the lower end 10*a* of the lever 10 is supported by the upper end 20*a* of the stopper Now, a mechanism for driving the above-described sheet supplying rollers will be described with reference to FIG. 4. A roller 40 is fixedly mounted on a shaft 41 which is in alignment with the central shaft 162 of the lower pusher roller 163. A guide roller cam 42 is fixedly coupled to the roller 40 on the shaft 41. A sector gear 50 is swingably supported by a shaft 44, and urged clockwise about the latter 44 by a spring 48. The sector gear 50 has a cam follower 46 at one end, which is abutted against the peripheral surface of the guide roller cam 42**.

The above-described lower sheet supplying roller 4 has a gear **4*a* at one end which incorporates a one-way spring (permitting rotation in one direction only). The gear 4*a* is engaged with the other end portion of the sector gear 50, namely, a toothed portion 50*a*. The lower sheet supplying roller 4 is turned only when the sector gear 50 is turned counterclockwise about the shaft 44 in FIG. 4**.

Gears (not shown) are fixedly secured to the ends of the upper and lower sheet supplying rollers 2 and 4, respectively. Only when the upper sheet supplying roller 2 is brought into contact with the lower sheet supplying roller 4, those gears are engaged with each other, to turn the sheet supplying rollers 2 and 4 in the opposite directions.

The sheet discharging section 179, as shown in FIG. 5, comprises: a pinch roller 193 provided at the sheet releasing position b, the pinch roller 193 cooperating with the lower pusher roller 163 to convey the printed sheet P; a sheet separating claw 195 for separating the printed sheet P from the lower pusher roller 163; a pair of pinch rollers 199 for sending the printed sheet P to a sheet throwing stand 197 which has been separated from the lower pusher roller 163; a sheet discharging stand 201 on which printed sheets P are stacked; and a sheet discharging optical sensor 203 for detecting when a printed sheet P is thrown from the sheet throwing stand 197 to the sheet discharging stand 201.

The pinch roller 193, and the upper pinch roller 199 are brought into contact with the upper printed surface of the printed sheet P; however, it should be noted that those pinch rollers are allowed to contact only both side marginal portions of the printed sheet P where nothing has been printed. That is, in order that those pinch rollers contact only both side margins of the printed sheet irrespective of the width of the printed sheet, the machine is so designed that the positions of those pinch rollers are automatically adjusted in the axial direction depending on the size of the printing sheet P set on the sheet supplying stand 181. For this purpose, the sheet supplying stand 181 is provided with a sheet size sensor (not shown) for detecting the size of a printing sheet P.

Figure 9:
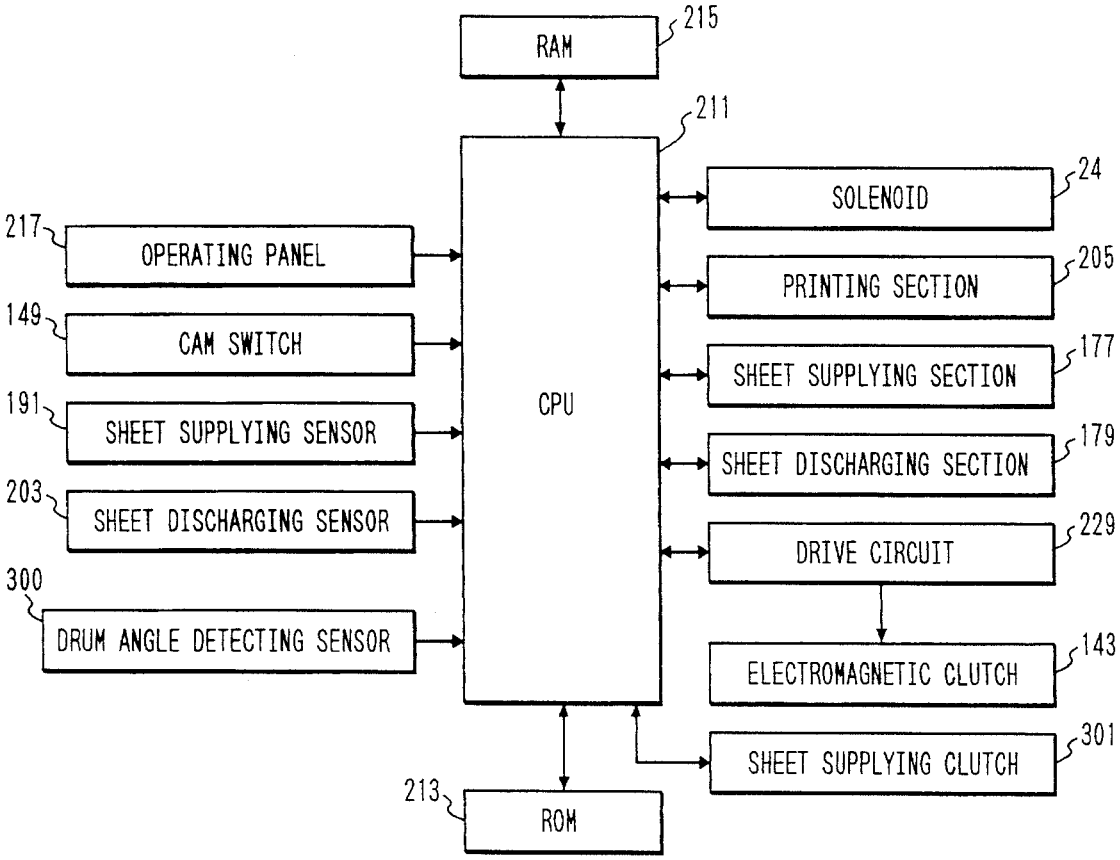
FIG. 9 is a block diagram showing a control system in the mimeographic printing machine of the invention.

FIG. 9 is a block diagram showing the arrangement of control means in the mimeographic printing machine according to the invention. The control means comprises: a CPU (central processing unit) 211 made up of a microprocessor; a ROM (read-only memory) 213 in which control programs have been stored; and a RAM (random access memory) 215 which stores input data at any time.

The CPU 211 receives output signals from an operating panel 217, a cam switch 149, a sheet supplying sensor 191, the sheet discharging sensor 203, a drum angle detecting sensor for detecting an angle of rotation of the flexible rotary cylindrical drum 1, and other sensors and switches provided in other sections.

The operating panel has: a ten-key board for setting the number of printing sheets and for the number of printing sets; a start key for starting a printing operation; and a display unit including LCDs for displaying the number of printing sheet, the number of printing sets, and other messages.

The CPU 211 is connected to a printing section 205 essentially including the flexible rotary cylindrical drum 1; to the sheet supplying section 177; to the sheet discharging section 179; to a drive circuit 229 including an electromagnetic clutch 143; to a sheet supplying clutch 301 for controlling the driving of the sheet supplying rollers 183; and to a solenoid 24 for operating the stopper for the above-described sheet supplying rollers 2 and 4. The CPU 211 processes signals from the above-described various sensors according to the control program, and controls the aforementioned circuit elements.

The CPU 211 applies an operating instruction to the drive circuit 229 of the electromagnetic clutch 143 in relation with the sheet supplying operation of the sheet supplying section 177, to control the electromagnetic clutch 143. As a result, the cam 135 is turned through 90° at a time, so that the inner pusher roller 123 is selectively set at the aforementioned steady position.

In addition, the CPU 211 controls the sheet supplying clutch 301 in synchronization with the driving of the printing section 205 thereby to control the vertical motion of the upper sheet supplying roller 2. When a drum angle detecting sensor 300 coupled to the CPU 211 detects that the flexible rotary cylindrical drum 1 is at a predetermined angular position, or when the sheet supplying sensor 191 or the sheet discharging sensor 203 detects that the conveyance of the printing sheet is abnormal, the CPU 211 operates the solenoid 24 to set the stopper 20 below the lever 10, so that the lower movement of the lever is limited. As a result, the upper sheet supplying roller 2 is held spaced from the lower sheet supplying roller 4. That is, the CPU 211 serves as control means for activating the preventing means.

Now, the operation of the mimeographic printing machine thus constructed will be described. First, a stencil paper is wound on the flexible rotary cylindrical drum 1. Under this condition, a ten-key board on the operating panel 217 is operated to input the required number of printing sheets, and the start key on the operating panel is operated. As a result, the flexible rotary cylindrical drum 1 and the lower pusher roller 163 are turned, while the printing sheets P are taken out of the sheet supplying stand 181 one by one by the sheet supplying rollers 183 and the sheet separating roller 185. The printing sheets P thus-taken out are delivered towards the sheet supplying rollers 2 and 4 while being guided by the sheet guide member 187.

When the flexible rotary cylindrical drum 1 and the lower pusher roller 163 are turned through a predetermined angle, the upper sheet supplying roller 2 is moved vertically through the lever 10 by the timing cam 16 which is turned in synchronization with the lower pusher roller 163, so that the rollers 2 and 4 deliver the printing sheet P to the sheet clamping position a on the lower pusher roller 163 with predetermined timing where the printing sheet P is to be clamped by the clamping piece 171. The delivery of the printing sheet P to the sheet clamping position a is detected by the sheet supplying sensor 191. If the sheet supplying sensor 191 is not turned on, then an operation stopping procedure is carried out, and a sheet supply failure procedure is performed to display it on a display unit on the operating panel that no printing sheet has been supplied.

Next, it is determined whether or not the cam switch 149 is turned on; that is, it is determined whether or not the cam 135 is at the printing position. If the cam switch 149 is not turned on, then the electromagnetic clutch 143 is energized for a predetermined period of time.

As a result, the cam 135 is turned through 90° to the printing position, and the inside pusher roller 123 is moved to the lower position as shown in FIG. 5. Hence, as the flexible rotary cylindrical drum 1 turns, the inside pusher roller 123 pushes the screen member 109 radially outwardly; that is, it inflates the screen member 109 towards the lower pusher roller 163.

Under this condition, the clamping piece 171 of the lower pusher roller 163 holds the front edge of the printing sheet P at the sheet clamping position a. As the lower pusher roller 163 turns, the printing sheet P thus held, while being wound on the lower pusher roller 163, is moved to meet the flexible rotary cylindrical drum 1. In this case, the printing sheet P is moved to the inflated portion of the screen member 109.

Thus, the printing sheet P is held between the inflated portion of the flexible rotary cylindrical drum 1 and the lower pusher roller 163 under a predetermined pressure. Hence, as the flexible rotary cylindrical drum 1 and the lower pusher roller 163 turn, the printing sheet P is subjected to mimeographic printing while being moved to the right in FIG. 5.

When the flexible rotary cylindrical drum 1 and the lower pusher roller 163 turn until the clamping piece 171 comes to the sheet releasing position b, the clamping piece 171 releases the sheet P. The sheet P thus released is conveyed by the sheet discharging pinch roller 193. Thereafter, the sheet P is separated from the lower pusher roller 163 by the sheet separating claw 195, and delivered to the sheet throwing stand 197 by the sheet discharging pinch rollers 199. Next, the sheet P is thrown from the sheet throwing stand 197 over to the sheet discharging stand 201, so that it is placed on the latter 201 with the printed side up.

During this sheet discharging operation, it is detected by the sheet discharging optical sensor 203 whether or not the sheet P reaches the sheet throwing stand 197 within a predetermined period of time which elapses from the time instant the sheet supplying optical sensor 191 is turned on. If the sheet P does not reach the sheet throwing stand 197 within the predetermined period of time, then the sheet supply failure procedure is performed.

On the other hand, in the case where the sheet discharging optical sensor 203 is turned on, in order to determine the completion of the sheet discharging operation it is detected whether or not the sheet discharging optical sensor 203 is turned off.

In the case where the sheet discharging optical sensor 203 is not turned off within a predetermined period of time which elapses from the time instant that the optical sensor 203 is turned on, the operation stopping procedure, and a sheet discharge failure procedure is performed to display it on the display unit on the operating panel 217 that the sheet is not discharged.

On the other hand, in the case where the sheet discharging optical sensor 203 is turned off within the predetermined period of time; that is, when it is determined that the sheet P has been thrown from the sheet throwing stand 197 over to the sheet discharging stand 201, a count value indicating the number of printed sheets is decreased by one. That is, it is determined from the count value whether or not the predetermined number of sheets have been printed.

When the sheet supplying optical sensor 191 or the sheet discharging optical sensor 203 detects that the conveyance of the printing sheet is abnormal, the solenoid 24 is operated to retract its operating part 24*a*, so that the stopper 20 is turned. clockwise in FIG. 3 to the position A (indicated by the phantom line). As a result, the lower end 10*a* of the lever 10 is abutted against the upper end 20*a* of the stopper 20, so that the lever 10 is prevented from moving downwardly; that is, the upper and lower sheet supplying rollers 2 and 4 are held spaced from each other.

Immediately when the jamming of printing sheets is detected, the solenoid 24 is energized, and the solenoid 24 is kept energized until the mimeographic printing machine is stopped. Hence, in the case when the solenoid 24 is driven with the lever 10 held raised, the stopper 20 engages with the lever 10 immediately. On the other hand, in the case when the solenoid 24 is driven with lever 10 held lowered, the stopper 20 does not immediately engage with the lever 10; that is, the stopper 20 is abutted against the side surface of the lever 10 until the latter 10 is raised. And immediately when the lever 10 is raised, the stopper 20 goes below the lever 10.

Figure 10:
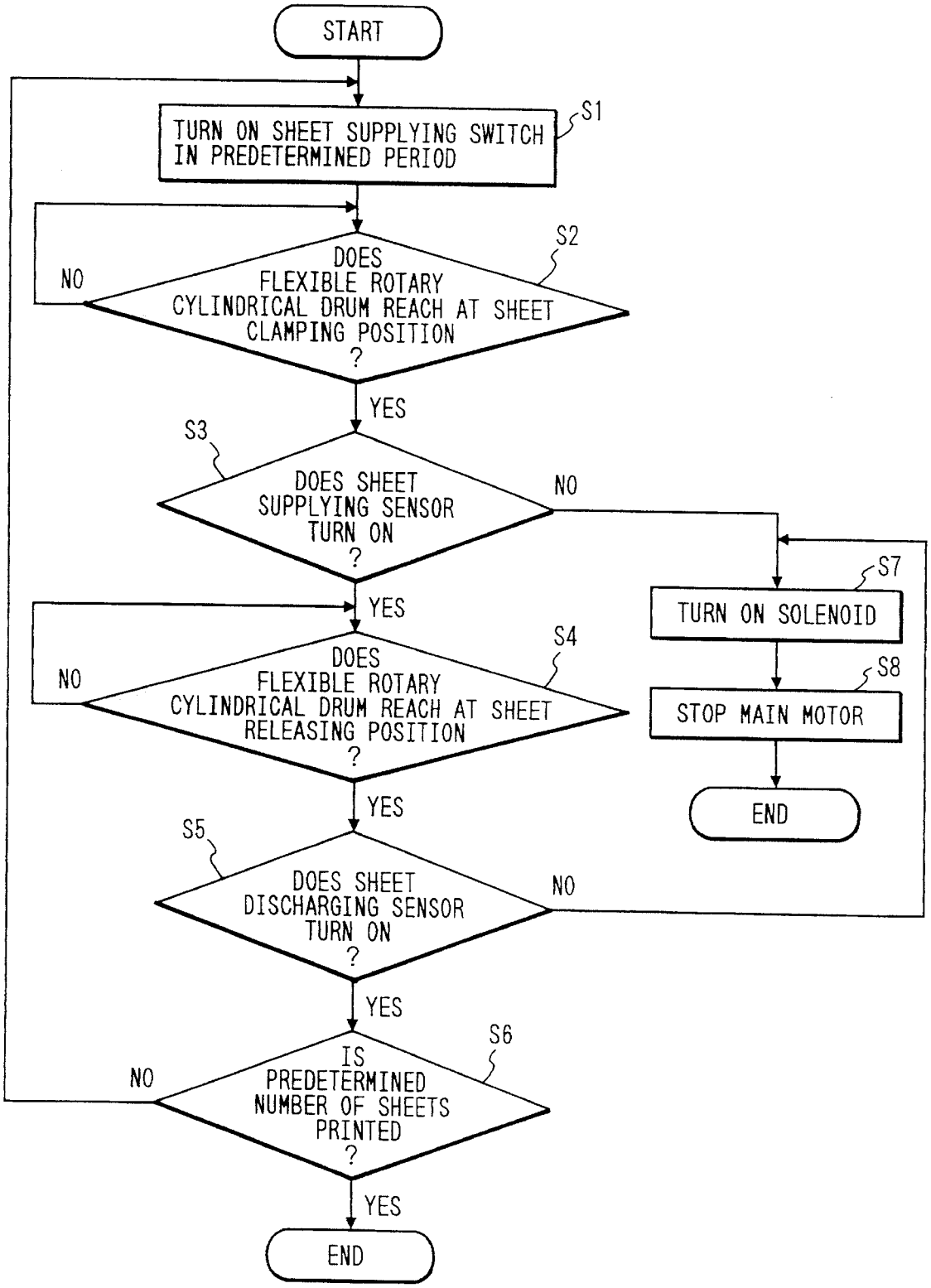
FIG. 10 is a flow chart showing an example of a control procedure for the mimeographic printing machine of the invention.

FIG. 10 is a flow chart showing an example of a procedure which the CPU 211 performs when the jamming of printing sheets occurs with the mimeographic printing machine. In Step S1, the sheet supplying clutch 301 is turned on for a predetermined period of time, to rotate the sheet supplying rollers 183.

In Step S2, it is determined whether or not the flexible rotary cylindrical drum 1 and the synchronously driven lower pusher roller have reached a flat sheet jamming detection position corresponding to the sheet clamping position a.

When it is determined that the flexible rotary cylindrical drum 1 and the pusher roller have reached the first sheet jamming detection position, in Step S3 it is determined whether or not the sheet supplying optical sensor 191 is turned on.

When it is determined that the optical sensor 191 is turned on, in Step S4 it is determined whether or not the flexible rotary cylindrical drum 1 and the lower pusher roller have reached the second sheet jamming detection position corresponding to the sheet releasing position b.

When it is determined that the flexible rotary cylindrical drum 1 and the lower pusher roller have reached the second sheet jamming detection position in Step S5 it is determined whether or not the sheet discharging optical sensor 203 is turned on.

When the optical sensor 203 is on, Step S6 is effected. In Step S6, it is determined whether or not a predetermined number of sheets have been printed. When it is determined that the predetermined number of sheets have been printed, the main motor is stopped which is the driving source for the printing section 205, the sheet supplying section 177 and the sheet discharging section 179. Thus, the mimeographic printing machine is stopped.

In the case where, in Steps S3 through S5, the sheet supplying optical sensor 191 or the sheet discharging optical sensor 203 is off, it is determined that the jamming of printing sheets has occurred somewhere in the printing sheet conveying path. And in Step S7, the solenoid 24 is driven; and in Step S8, the main motor is stopped.

The mimeographic printing machine has been described above in which the rotary cylindrical drum is made of a flexible material, the inside pusher roller is provided inside the rotary cylindrical drum to elastically deform the tubular wall of the latter in a radial direction, and a printing sheet is supplied into the space between the rotary cylindrical drum and the lower pusher roller set in parallel with the latter so that it is pushed by the tubular wall of the drum; however, the invention is not limited thereto or thereby. That is, in the above-described embodiment, the inside pusher roller is used to elastically deform the tubular wall of the rotary cylindrical drum; however, the technical concept of the invention may be applied to a mimeographic printing machine in which the lower pusher roller is moved vertically, or to a mimeographic printing machine in which a press roller mechanism smaller in outside diameter than the rotary cylindrical drum is employed to push a printing sheet against a stencil paper wound on the tubular wall of the rotary cylindrical drum.

Furthermore, in the above-described embodiment, the upper sheet supplying roller is moved to and from the lower sheet supplying roller which is stationary. However, it goes without saying that the invention is applicable to a mimeographic printing machine in which the lower sheet supplying roller is moved to and from the upper sheet supplying roller which is stationary.

In general, when the jamming of printing sheets is detected, the conventional mimeographic printing machine is not immediately stopped; that is, it is stopped after two or three turns of the rotary cylindrical drum. Hence, if the jamming of printing sheets occurs in the conventional mimeographic printing machine, then the sheets are moved deep in the machine. Hence, it is rather difficult to remove those sheets from the machine. On the other hand, in the mimeographic printing machine of the invention, the sheets will never be moved deep in the machine, and they can be removed with ease.

In the mimeographic printing machine of the invention, the downward movement of the upper sheet supplying roller can be prevented merely by driving the solenoid. Thus, the printing machine is simple in construction, low in manufacturing cost, and reliable in operation, and is substantially trouble-free.

In addition, as is apparent from the above description, in the mimeographic printing machine of the invention, the pair of sheet supplying rollers 2 and 4 are moved to and from each other in synchronization with the rotation of the rotary cylindrical drum 1; that is, when the clamp plate 111 of the rotary cylindrical drum 1 is located above, the two sheet supplying rollers 2 and 4 are moved away from each other; and when the clamp plate 111 is located below, the rollers 2 and 4 are moved towards each other. This is because the rollers 2 and 4 are mechanically moved towards or away from each other by using the cam 16. The movement of the rollers 2 and 4 to and from each other may be electrically achieved by using an electrical clutch or the like; however, at present, no electrical clutch is available which meets the printing speed of the mimeographic printing machine, and therefore it is forced to employ the mechanical control. In the above-described mimeographic printing machine, in order that the stencil paper laid on the tubular wall of the rotary cylindrical drum may not be made dirty when the latter is loaded in or unloaded from the machine, the drum is stopped when the clamp plate takes the lower position. Hence, if, when the jamming of printing sheets occurs and the rotary cylindrical drum is stopped, there is no means for preventing the sheet supplying rollers from approaching each other, then it is difficult to remove the sheets from the machine.

In the above-described mimeographic printing machine, the rotary cylindrical drum is flexible and the inside pusher roller is used for deforming the rotary cylindrical drum outwardly. Therefore, the printing operation is performed. However, the rotary cylindrical drum may not be flexible. In this case, the lower pusher roller is pushed the printing sheet against the stencil paper wound on the rotary cylindrical drum. Hence, the printing operation can be achieved.

When the jamming of printing sheets occurs in the mimeographic printing machine, the pair of sheet supplying rollers can be held spaced away from each other so as not to clamp a printing sheet between them. Hence, the printing sheets can be removed from the machine with ease. This means that the machine is high in operability. The mimeographic printing machine having the above-described pair of sheet supplying rollers should be highly appreciated in practical use and in functional advantage.

What is claimed is:

1. A mimeographic printing machine comprising:

first and second sheet supplying rollers;

means for providing relative movement between said first and second rollers between a first position at which said first and second rollers are in contact and a second position at which said first and second rollers are separated, said first and second rollers clamping a printing sheet when said first and second rollers are in said first position, and said first and second rollers being rotatable to convey the printing sheet;

a rotary cylindrical drum having a tubular wall on which a stencil paper is wound;

pushing means for pushing the printing sheet conveyed by rotating said first and second rollers against the stencil paper wound on said rotary cylindrical drum in order to perform a mimeographic printing operation;

jamming detecting means for detecting abnormal conveyance of printing sheets in a printing-sheet conveying path;

preventing means for preventing said first and second rollers from assuming said first position; and control means for automatically activating said preventing means when said jamming detecting means detects the abnormal conveyance of the printing sheet in said printing-sheet conveying path.

2. A mimeographic printing machine according to claim 1, wherein said mimeographic printing machine further comprises: a shaft provided in parallel with the axis of said first sheet supplying roller; an arm member mounting said first sheet supplying roller therein; and means for rotatably supporting said arm member on said shaft, and wherein said preventing means includes: a stopper along the locus of rotation of said arm member, for preventing said arm member from moving; and drive means for moving said stopper into and out of said locus of rotation.

3. A mimeographic printing machine according to claim 1, wherein said jamming detecting means includes: a sheet supplying sensor provided upstream of said rotary cylindrical drum; and a sheet discharging sensor provided downstream of said rotary cylindrical drum.

4. A mimeographic printing machine according to claim 3, wherein said jamming detecting means further includes determining means for determining the time between which said sheet supplying sensor and said sheet discharging sensor are activated by the conveyance of said printing sheet, wherein when said time is greater than a predetermined time, said jamming detecting means detects said abnormal conveyance of said printing sheet.

* * * * *